United States Patent [19]

Primeau

[11] Patent Number: 4,972,045

[45] Date of Patent: Nov. 20, 1990

[54] ELECTRICAL SWITCH PLATE COVER

[75] Inventor: Mario Primeau, Saint-Léonard, Canada

[73] Assignee: Groupe Sodepro Inc., Drummondville, Canada

[21] Appl. No.: 330,372

[22] Filed: Mar. 29, 1989

[30] Foreign Application Priority Data

Jan. 17, 1989 [CA] Canada ..... 5884195

[51] Int. Cl.[5] ..... H01H 3/02

[52] U.S. Cl. ..... 174/66; 200/330

[58] Field of Search ..... 174/66, 67; 220/241, 220/242; 200/297, 330, 331

[56] References Cited

U.S. PATENT DOCUMENTS

| | | | |
|---|---|---|---|
| 801,536 | 10/1905 | Marshall | 220/241 |
| 1,717,871 | 6/1929 | Both | 220/241 |
| 2,212,145 | 8/1940 | Benander | 174/66 X |
| 2,571,837 | 10/1951 | Coles | 200/330 |
| 4,105,884 | 8/1978 | Damsky | 200/331 |

*Primary Examiner*—Gerald P. Tolin
*Assistant Examiner*—David A. Tone
*Attorney, Agent, or Firm*—Pierre Lesperance

[57] ABSTRACT

A structure for facilitating the gripping and operating of a control lever of an electrical switch plate mounted into an electrical box embedded into a wall. The structure comprises a movable plate having a large central projection. The projection defines a trough in which the control lever engages, and two large abutting surfaces opposite the trough and orthogonal to the wall, the plate being slidable within a plane parallel to the wall. A cover is fixedly secured to the electrical box by its square central section the plane of which is interiorly offset with respect to the main body of the cover. The central section is upwardly and downwardly open to enable sliding action of the movable plate parallel to the wall, within the plane of the cavity. Thus, the movable plate hides the control lever as well as the screws that secure the cover to the electrical box, and is retained by the guide walls of the cover. In accordance with the invention, a modular covers assembly is also provided for use with electrical plugs as well as electrical switches. These various modules are interconnected by dovetailed connectors.

9 Claims, 5 Drawing Sheets

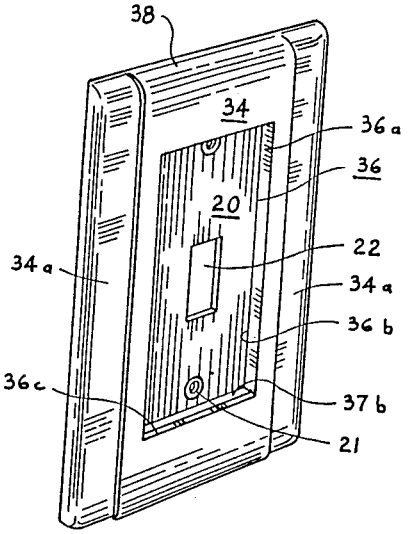
FIG. 5
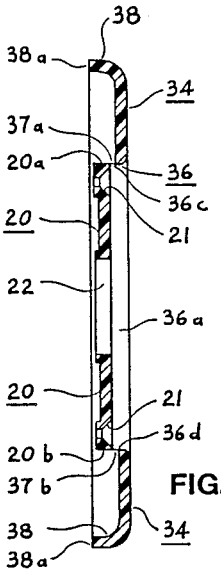
FIG. 6
FIG. 7
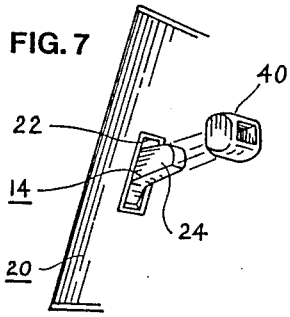
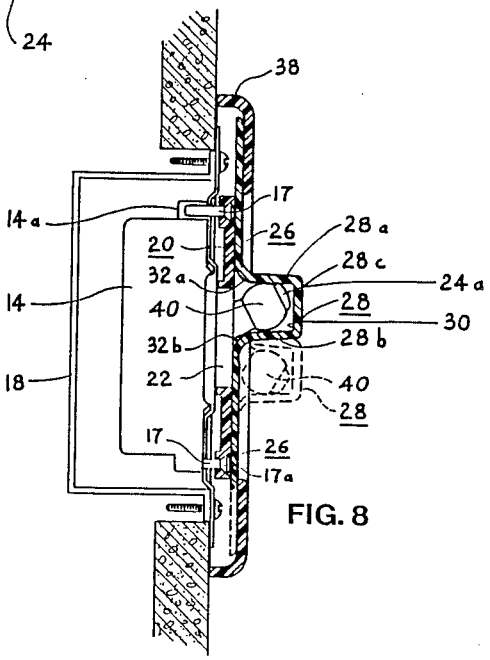
FIG. 8

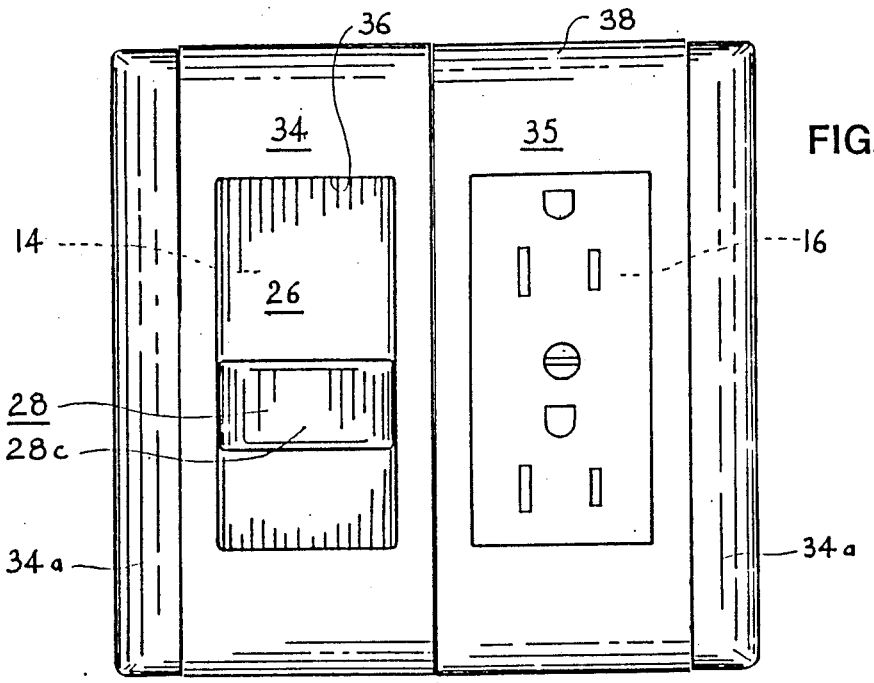
FIG. 9
FIG. 10
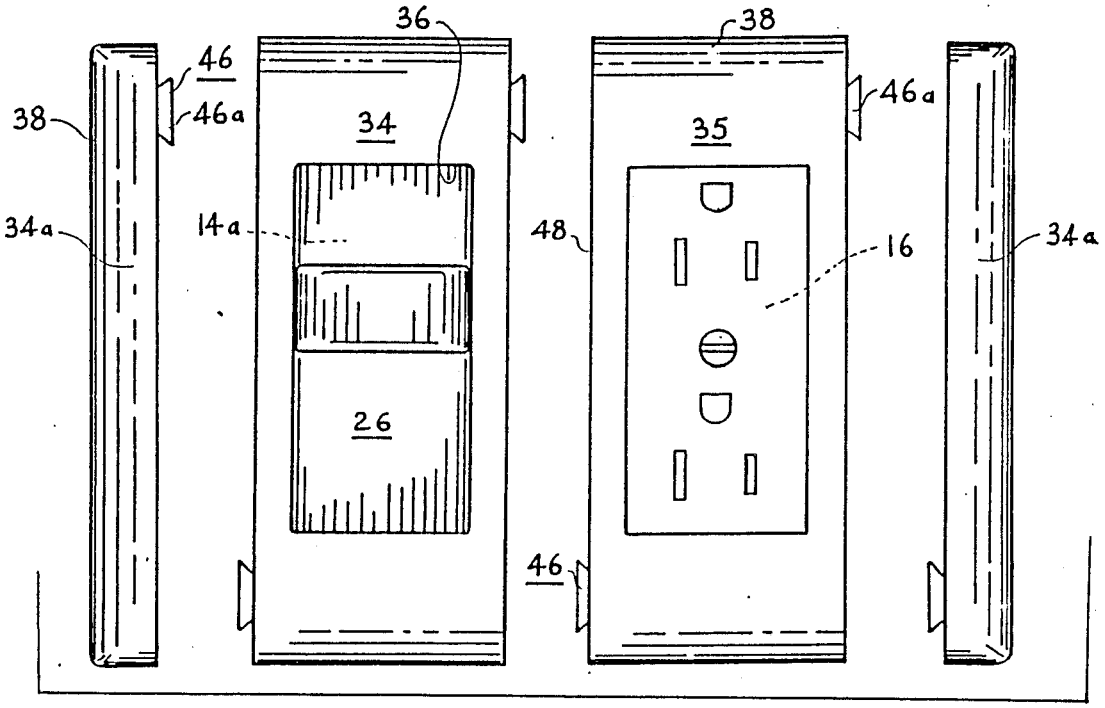

ELECTRICAL SWITCH PLATE COVER

FIELD OF THE INVENTION

This invention relates to plastic material hardware for electrical systems.

BACKGROUND OF THE INVENTION

The control of the operating lever of a conventional electrical switch being secured to the wall means a top-to-bottom or bottom-to-top pivotal movement thereof about a horizontal axis, i.e. a relatively complex movement which does not facilitate the manual operation of the switch. Moreover, the control lever-switch is usually of small dimensions, which does not facilitate the gripping thereof.

OBJECTS OF THE INVENTION

The goal of the invention is to facilitate the gripping and the control of the control lever of an electrical switch.

Another goal of the invention is to hide from view the switch lever without hampering the operation thereof.

Another object of the invention is to provide an array of interconnected modular covers used for electrical plugs as well as electrical switches, these various modules being interconnected by dovetailed connectors.

SUMMARY OF THE INVENTION

In accordance with the teachings of the invention, there is disclosed a member for facilitating the gripping and operating of the control lever of an electrical switch, comprising: a cover having a main body surrounding a central cavity, said cavity defining a small plate having a central opening through which extends said control lever and securing means for securing said small plate to said switch, the plane of said small plate being offset toward said switch with respect to said main body plane and defining upper and lower slits between the small plate and the main body; and a larger plate having a larger central projection, said projection defining a trough in which said control lever is engaged and two large abutting surfaces opposite said trough, said larger plate being positioned against said small plate and being engaged into said slits so as to be able to slide therebetween during pivotal action of said control lever.

Preferably, said control lever is generally cross-sectionally quadrangular, and further comprising a cap made from a semi-rigid material and having a cross-sectionally quadrangular through-bore being engageable by said control lever and a rounded external surface for cooperating with the walls of said projection within said trough during said sliding of said larger plate. Advantageously, said cap is made from polyethylene.

Profitably, said cover comprises a peripheral, interiorly edge section, whereby said small plate extends beyond the plane of the free edge of said cover rounded edge section.

It is envisioned that said securing means be screws, extending through said small plate, the screws each having a head, said heads being hidden by said movable small plate.

Preferably, said cover consists of three modules of which two side ones are interconnected by fastening means, so as to enable the combination of several covers by removal of the side modules of the intermediate covers. Said fastening means could be dovetailed connectors.

The invention also consists in an assembly of modular covers each used for covering an electrical plug or an electrical switch mounted into an electrical box secured to a wall, each cover having a main quadrangular body surrounding a central part, said part defining a small plate having an opening about which access to said electrical switch or electrical plug can be gained, securing means for securing said small plate to said electrical box; each of said modular covers defining two side edge sections having fastening means for enabling the interconnection in a substantially common plane of adjacent covers and the removable fastening thereof.

Again, said fastening means are preferably dovetailed connectors. There is also profitably further comprised two thin rectangular blocks, one of the side edge sections of which comprises second fastening means destined to cooperate with the first-mentioned fastening means of an adjacent cover and with the other three side edge sections being rounded, said two blocks being mounted on the two opposite side ends of said assembly of covers.

BRIEF DESCRIPTION OF THE DRAWINGS

FIG. 5 is a perspective view of the cover;

FIG. 6 is a longitudinal sectional view of the cover;

FIG. 7 is a partial view of the cover and of the switch lever showing the cap released from the switch lever;

FIG. 8 is a longitudinal section view of the assembly consisting of the electrical box, the electrical switch, the operating plate and of the cover;

FIG. 9 shows an elevational view of a modular assembly for electrical switch and electrical plug;

FIG. 10 shows an exploded view of the elements of FIG. 9;

DETAILED DESCRIPTION OF THE INVENTION

Figure 1:
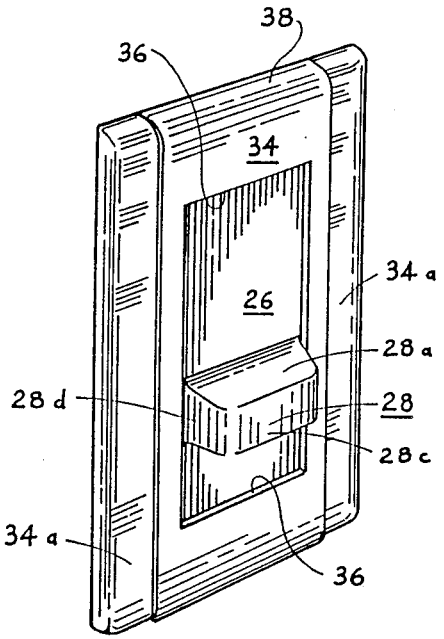
FIG. 1 is a perspective view of an assembly of electrical switch plate and of cover plate in accordance with a preferred embodiment of the invention.
Figure 2:
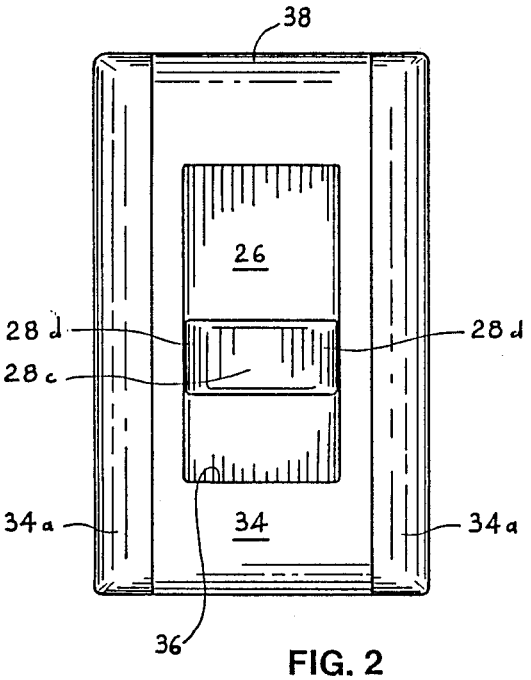
FIG. 2 is a front elevational view of the assembly of plate of FIG. 1.
Figure 3:
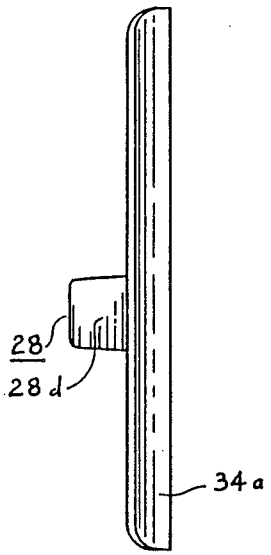
FIG. 3 is a side elevational view of the plate assembly of FIG. 1.
Figure 4:
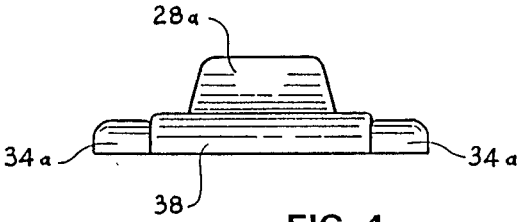
FIG. 4 is an end view of the assembly of FIG. 1.
Figure 11:
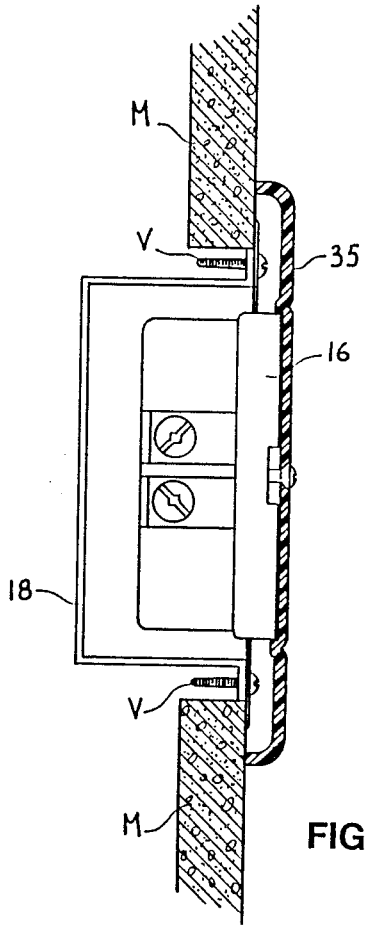
FIG. 11, taken along line 11—11 of FIG. 10, shows a longitudinal sectional view of a wall with an electrical box, of an electrical plug covered with the cover of the invention.

The electrical switch 14 (FIG. 8) or the electrical plug 16 (FIG. 11) are conventionally destined to be mounted into an electrical box 18, which is embedded and fixedly secured into a cavity made into a wall M. The switch 14 or the plug 16 have ears O and screws V engaging these ears O and which are screwed to the box 18. A switch plate, 20, covers the front of the box 18, and comprises a vertical, rectangular slit 22 for through passage of the control lever 24 of the electrical switch 14 and for the up-and-down pivotal action thereof about a horizontal axis, between an open and a closed position. The plate 20 comprises conical bores 21 engaged by dome-shaped-head screws 17, which screw into front threaded cavities 14*a* of the switch 14 as is well known, for securing the plate 20 against the front of the electrical box 18. The head 17*a* of each screw 17 is then exteriorly visible from the plate 20.

In accordance with the invention, there is provided a second plate 26, which flatly abuts against the first plate 20. The plate 26 comprises a projection 28 at the intermediate central section thereof, about the two thirds of its width but of small height, thus constituting a U laid on the side in cross-section. The projection 28 defines an upper wall 28*a*, a lower wall 28*b*, a front wall 28*c*, and two side walls 28*d*, as well as an interior trough 30 into which engages the control lever 24. Hence, the latter is hidden from the outside. The walls 28*a*, 28*b* and 28*d* are curved at their interior ends 32*a*, 32*b* so as to become integral to the main body of the plate 26. The free end 24*a* of the control lever 24 stops short of the front vertical wall 28*c*.

Therefore, by vertically sliding the plate 26 against the plate 20, the switch lever 24 is drawn into a pivotal movement about a horizontal axis, thanks to the frictional interaction between the lever and the walls 28*a*, 28*b* and their curved areas 32*a*, 32*b*. Indeed, in the closed position as shown in dotted lines in FIG. 8, i.e. when the control lever 24 is downwardly-forwardly extending, the free end 24*a* of the control lever abuts against the front section of the wall 28*b* whereas the rear section thereof abuts against the curved area 32*a*; on the other hand, in the open position, i.e. when the control lever 24 is upwardly and forwardly extending, as suggested in full lines in FIG. 8, the free end 24*a* abuts against the front section of the wall 28*a* whereas the rear section thereof abuts against the curved area 32*b*. It is understood that the walls 28*a*, 28*b* constitute abutting surfaces for the run of lever 24, whereas the curved surfaces 32*a*, 32*b* constitute stop members which limit the run of the plate 26 along the plate 20.

A cover 34 is made integral to the plate 20, which defines the bottom of a central, rectangular plate 36 made into the cover 34. Indeed, the two elongated side edges of the plate 20 are integral to the rear edge 36*b* of the two side walls 36*a* of the cavity 36 of the cover 34. Thus, the plane of the plate 20 is rearwardly offset, i.e. interiorly with respect to the plane of the cover 34. However, the cavity 36 comprises upper and lower slits 37*a*, 37*b*, within a common vertical plane and being defined between the top and bottom edges 20*a* and 20*b* of the plate 20 (which is rearwardly offset as already detailed) and the corresponding edges 36*c*, 36*d* of the cover 34. The plate 26 is engaged into the slits 37*a*, 37*b*; it is long enough so as not to project beyond these slits (see FIG. 8). Thus, the plate 26 may slide with said common vertical plane of the slits 37*a*, 37*b*, is guided by same and by the side walls 36*a*, is retained by the cover 34 and hides not only the head 17*a* of each securing screw 17 for securing the cover to the switch 14 but also the control lever 24.

The cover 34 also comprises peripheral edges 38 which are interiorly rounded at right angle. The side sections 34*a* of the plate 34 are rearwardly offset and may be made releasable in two rectangular sections, see FIGS. 9 to 14.

Advantageously, there is provided in accordance with the invention the addition of a cap 40, having a rounded external surface 42 but having a cross-sectionally quadrangular through-bore 44, engaged by the control lever 24 and extending within the internal trough of the projection 30. The cap 40 is made from a flexible material, e.g. polyethylene, and facilitates the interaction of walls 28*a*, 28*b* with the lever during pivotal motion of the latter, as well as the dampening of the limit displacements of the switch lever. The block or projection 28 extends forwardly of plate 26 and is large, and its upper wall 28*a* and lower wall 28*b* are flat and horizontal.

The projection 28 thus facilitates the gripping as well as the control of the lever 24, since it requires for its operation a vertical push rather than a pivotal bias.

In accordance with the prior technique, the lever 24 is as such quite small, wherein the gripping thereof is not facilitated, and the displacement thereof is made by pivotal action, which constitutes a relatively complex motion compared to a simple linear motion.

FIGS. 9 to 14 show how the covers 34 and 35 of an electrical switch 14 and of an electrical plug, respectively, have side sections 34*a* which are releasable and which may be directly interconnected so that the same covers may be used with electrical switches and/or plugs and mounted side-by-side in a single electrical box as well as with switches or plugs installed in individual boxes.

It is to be noted that the individual and conventional covers or wall plates, are too large to be used with an electrical box having several switches or plugs in side-by-side fashion. Each cover 34, 35 has a width equal to the standard distance center-to-center between two plugs or switches installed side-by-side in a single box. A cover 34 or 35 provided with its two sides 34*a* has a width large enough to cover an individual box.

Figure 14:
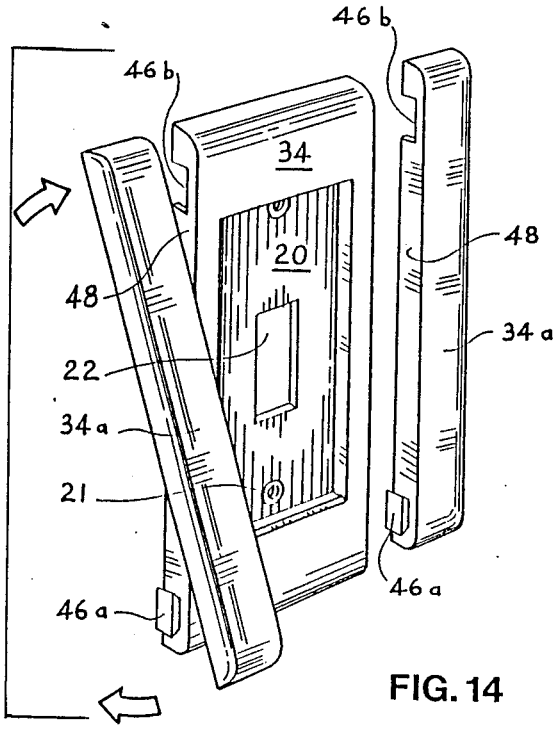
FIG. 14 is a perspective, exploded view of the members of FIG. 5, showing how the side strips of the electrical plate are fixedly secured thereto by dovetailed connectors.
Figure 12:
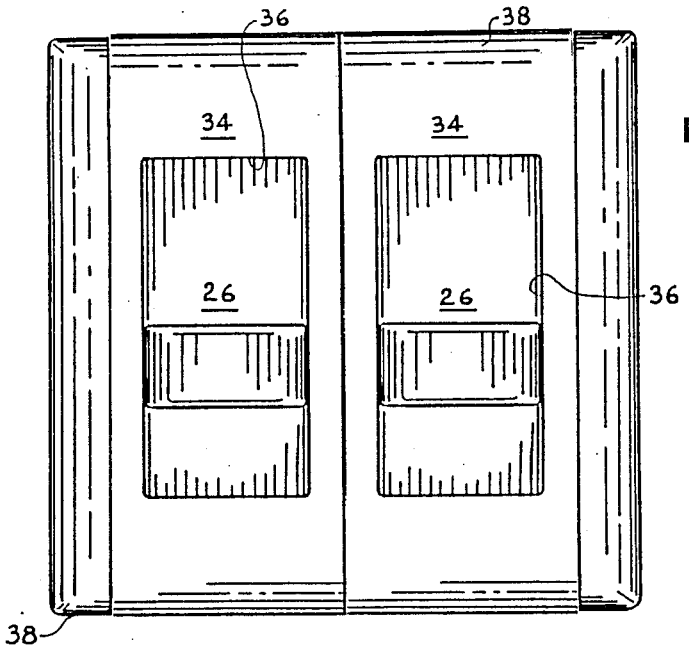
FIG. 12 shows an elevational view of another modular system assembly, to wit for two electrical switches.
Figure 13:
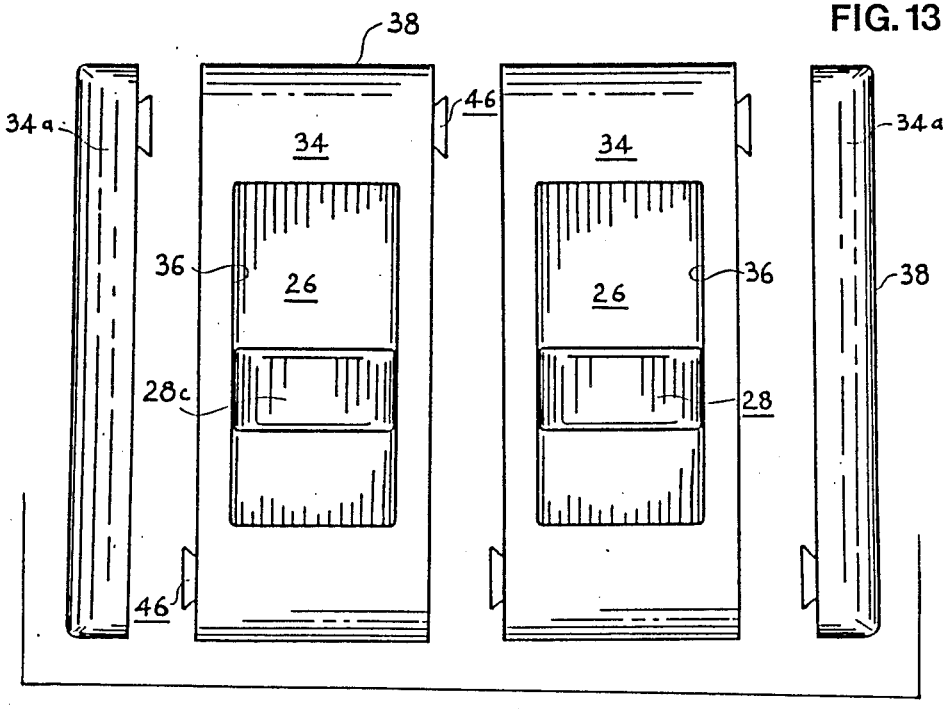
FIG. 13 shows a front, elevational, exploded view of the members of FIG. 12.

The constituting modules may be interconnected by dovetailed connectors, 46, see FIG. 14. These types of connectors have a male part 46*a*, of trapezoidal shape in side view, and a female part 46*b*, constituted by a rectangular-shaped notch. Each part 34,35, and 34*a* comprises side walls 48; the male parts 46*a* project from the side walls 48, and the notches 46*b* are made in the walls 48 and have inclined edges to follow the contour of the male part 46*a*. Each cover or plate 34 and 35 is provided on each side thereof with a male part 46*a* and with a female notch 46*b* positioned near the ends of the covers and being relatively inverted. Each side strip 34*a* has a male part and a female part. Each side strip 34*a* may thus be hooked to either one or to both sides of a cover 34 or 35 and these covers may be directly hooked to each other. Thus, with three modules, one may obtain all the usual combinations. The hooking action is made by pivoting one part with respect to the other following the arrows shown in FIG. 14. The dovetailed connectors 46*a* frictionally engage the notches 46*b*.

The interior or rear edge 38*a* of the peripheral curved portion 38 (FIG. 6) of the cover 34 defines a common vertical plane which is rearwardly offset relative to the plane within which extends the plate 20 (integral to the edges 36*a*, 36*b* of the cover 34). Therefore, the rear edge 38*a* abuts against the wall M (FIG. 11) even though the switch 14 projects slightly outwardly from that wall M.

Advantageously, the plates 26 and the covers 34 and 35 are made from a rigid plastic material, by molding.

I claim:

1. In combination, an electrical switch having a frame from which transversely projects a toggle control lever, and a switch operating member for facilitating the gripping and operating of the control lever, said operating member comprising: a cover having a main body surrounding a central cavity, said cavity defining a small plate having a central opening through which releasably extends said control lever and securing means for securing said small plate to said switch frame, the plane of said small plate being offset toward said switch frame with respect to said main body plane and defining upper and lower slits between the small plate and the main body; and a larger plate having a large central projection, said projection defining a trough in which said control lever is releasably engaged and two large opposite abutting walls alternatiely engaged by said toggle lever upon pivotal action of said lever, said larger plate being positioned against said small plate and being engaged into said slits so as to be able to slide therebetween during pivotal action of said control lever.

2. An assembly as defined in claim 1, wherein said control lever is generally cross-sectionally quadrangular, and further comprising a cap made from a semi-rigid material and having a cross-sectionally quadrangular through-bore, being releasably engaged by said control lever, and a rounded external surface, for cooperating with said abutting walls of said projection within said trough during said sliding of said larger plate.

3. An assembly as defined in claim 2, wherein said cap is made from polyethylene.

4. An assembly as defined in claim 1, wherein said cover comprises a peripheral, interiorly rounded edge section, whereby said small plate extends beyond the plane of the free edge of said cover rounded edge section.

5. An assembly as defined in claim 1, wherein said securing means are screws, extending through said small plate, the screws each having a head, said heads being hidden by said movable larger plate.

6. An assembly as defined in claim 1, wherein said cover consists of three modules of which two side ones are interconnected by fastening means, so as to enable the combination of several covers by removal of the side modules of the intermediate covers.

7. An assembly as defined in claim 6, wherein said fastening means are dovetailed connectors.

8. In combination, a toggle lever from an electrical switch anchored to a wall, and an operating member for pivoting said toggle lever about a pivotal plane between two limit positions, said operating member defining:

(a) a switch plate, defining a small central bore;

(b) first securing means, to secure said switch plate to said wall spacedly outwardly therefrom and parallel thereto and in register with said switch;

(c) a cover, defining a large central bore;

(d) second securing means, to secure said cover to said wall spacedly outwardly from said switch plate, in register thereto and parallel thereto, wherein a pair of upper and lower slits are defined by said cover large bore between said cover and switch plate, said slits defining a plane orthogonal to said toggle pivotal plane and a lengthwise axis within said pivotal plane; wherein said toggle lever releasably freely extends through said bores; and (e) a slidable plate, slidably engaged into said slits for sliding motion along said lenglthwise axis thereof between two limit positions corresponding to said toggle lever limit positions, said slidable plate having a central projection transversely outwardly projecting relative to said wall and defining a well into which is releasably engaged the toggle lever; wherein said slidable plate carries during its motion said toggle lever in its pivotal motion, said switch including the toggle lever being concealed from view by the operating member; and said operating member greatly facilitating manual actuation of said toggle lever, particularly when the latter is of small dimensions relative to the hand of a user person.

9. An assembly as in claim 8, further including an elastomeric cap, releasably mounted to said toggle lever and cooperating with said slidable plate projection to dampen the pivotal motion of the toggle lever upon sliding displacement of said slidable plate.

* * * * *